US006446357B2

(12) United States Patent
Woerdehoff et al.

(10) Patent No.: US 6,446,357 B2
(45) Date of Patent: Sep. 10, 2002

(54) FUZZY LOGIC CONTROL FOR AN ELECTRIC CLOTHES DRYER

(75) Inventors: Christopher J. Woerdehoff, Sawyer; Patrick J. Glotzbach, St. Joseph; Andrew C. Reck, Watervliet, all of MI (US); Joseph M. Szynal, Laporte, IN (US); Beth A. Maddix, Pepperell, MA (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 09/886,717

(22) Filed: Jun. 21, 2001

Related U.S. Application Data

(60) Provisional application No. 60/215,429, filed on Jun. 30, 2000.

(51) Int. Cl.[7] ..... F26B 3/00

(52) U.S. Cl. ..... 34/491; 34/495; 34/474; 34/562; 34/499

(58) Field of Search ..... 34/491, 495, 493, 34/496, 474, 475, 497, 557, 606, 562, 499

(56) References Cited

U.S. PATENT DOCUMENTS

| | | | | | |
|---|---|---|---|---|---|
| 4,139,953 | A | * | 2/1979 | Gaskell | 34/23 |
| 5,291,667 | A | | 3/1994 | Joslin et al. | 34/44 |
| 5,347,727 | A | | 9/1994 | Kim | 34/491 |
| 5,619,614 | A | * | 4/1997 | Payne et al. | 395/3 |
| 5,647,231 | A | * | 7/1997 | Payne et al. | 68/12.01 |
| 5,649,372 | A | | 7/1997 | Souza | 34/496 |
| 5,682,684 | A | * | 11/1997 | Wentzlaff et al. | 34/495 |
| 5,893,218 | A | * | 4/1999 | Hunter et al. | 34/492 |
| 5,899,005 | A | | 5/1999 | Chen et al. | 34/528 |
| 6,047,486 | A | * | 4/2000 | Reck et al. | 34/491 |
| 6,098,310 | A | * | 8/2000 | Chen et al. | 34/475 |
| 6,122,840 | A | * | 9/2000 | Chbat et al. | 34/496 |
| 6,141,887 | A | * | 11/2000 | Chen et al. | 34/475 |

FOREIGN PATENT DOCUMENTS

| | | | | |
|---|---|---|---|---|
| DE | WO 96/11284 | * | 4/1996 | C13C/3/00 |
| EP | 0388939 | | 9/1990 | D06F/58/28 |
| JP | 410999 | | 4/1992 | D06F/58/28 |
| JP | 5137896 | | 6/1993 | D06F/58/28 |

* cited by examiner

*Primary Examiner*—Ira S. Lazarus
*Assistant Examiner*—K. B. Rinehart
(74) *Attorney, Agent, or Firm*—Robert O. Rice; Thomas J. Roth; Stephen D. Krefman

(57) ABSTRACT

A method and apparatus for controlling the drying cycle of a dryer by utilizing fuzzy logic control. Control is accomplished by first monitoring the moisture level of a clothes load in the dryer. From the monitored moisture information, variables such as the elapsed time from the start of the drying cycle to a point when no significant moisture is detected for a specified time period and the number of times higher moisture registrations occur during another specified time period are determined. Based on the determined variables, fuzzy logic is used to determine characteristics particular to the clothes load being dried, such as size of the load. Using the determined characteristics in conjunction with user settings more accurate control of the time of drying heat application, reduced drying heat application and cool down time can be accomplished.

36 Claims, 8 Drawing Sheets

COTTON/TOWELS (HEAVY) CYCLE SELECTION

| NUM25_27 | TIME0 | | | | |
|---|---|---|---|---|---|
| LOAD TYPE / LOAD TYPE | VS | S | M | L | VL |
| VS | 15/5 | 15/5 | 15/5 | 15/5 | 15/5 |
| S | 18/3 | 15/5 | 15/5 | 15/5 | 18/5 |
| M | 18/0 | 18/3 | 20/3 | 20/5 | 20/5 |
| L | 18/0 | 20/0 | 20/0 | 22/0 | 22/5 |
| VL | 5/0 | 5/0 | 20/0 | 20/0 | 20/0 |

Fig. 5A

NORMAL CYCLE SELECTION

| NUM25_27 | TIME0 | | | | |
|---|---|---|---|---|---|
| LOAD TYPE / LOAD TYPE | VS | S | M | L | VL |
| VS | 15/5 | 18/5 | 15/5 | 15/5 | 15/5 |
| S | 15/3 | 15/0 | 15/5 | 15/5 | 18/5 |
| M | 15/0 | 15/0 | 20/3 | 20/5 | 20/5 |
| L | 15/0 | 15/0 | 18/0 | 18/0 | 22/5 |
| VL | 15/0 | 15/0 | 18/0 | 18/0 | 25/0 |

Fig. 5B

| DRYING CYCLE | TEMPERATURE |
|---|---|
| Cotton/Towels | High heat until damp signal, then medium high heat until cool down |
| Jeans | High heat until damp signal, then medium heat until cool down |
| Bulky Items | Medium high heat until damp signal, then medium heat until cool down |
| Normal | High heat for 5 minutes, then medium high heat until damp signal, then medium heat until cool down |
| Delicate/Casual | Medium high heat until damp signal, then low heat until cool down |
| Ultra Delicate | Low heat for 5 minutes, then extra low heat until cool down |

Fig. 6A

| TEMPERATURE DEFINITION | | |
|---|---|---|
| High | 155°F upper limit | 143°F lower limit |
| Medium High | 150°F upper limit | 138°F lower limit |
| Medium | 140°F upper limit | 128°F lower limit |
| Low | 125°F upper limit | 115°F lower limit |
| Extra Low | 105°F upper limit | 95°F lower limit |

Fig. 6B

FUZZY LOGIC CONTROL FOR AN ELECTRIC CLOTHES DRYER

This application claims the benefit of provisional application Serial No. 60/215,429, filed Jun. 30, 2000.

BACKGROUND OF THE INVENTION

The present invention relates to a method and apparatus for controlling parameters of a drying cycle for a clothes dryer using sensor-based fuzzy logic.

Typically in dryers known in the art, full heating energy is applied to a clothes treatment chamber throughout a drying cycle up to a point in time when a sensed moisture content of the clothes is reduced below a threshold level. At this point or a predetermined time period thereafter, the drying energy is terminated and the drum of the dryer continues to rotate for a predetermined amount of time to allow cooling of the clothes treatment chamber. When a sufficient time to allow cooling or a cool down temperature has been reached, the dryer is then shut-off. Alternatively, it is also known in the art to simply maintain an exhaust temperature of the dryer at a set temperature level after an initial period of heating from the start of the drying cycle for a predetermined time period.

Studies have shown that users of prior art dryers believe that automatic drying cycles either leave their clothes over-dried or underdried. As a result, users will more frequently use timed drying cycles to guarantee dryness or, alternatively, intervene during the drying cycle to remove clothes in mid-cycle to prevent over-drying based on fear of shrinkage and fabric damage. In addition, conventional dryers set drying temperature based on a drying cycle selection and do not control the temperature based on the clothes moisture content. Typically, higher temperatures are required to heat the clothes load at the beginning of a drying cycle and consequently remove a higher percentage of the moisture from the clothes load. However, as the clothes moisture content decreases, the temperatures of the clothing fabrics can increase rapidly, thus causing possible damage to the clothes.

Moreover, conventional dryers do not estimate remaining time in a drying cycle taking into account differing load sizes and types. Thus, the estimated time can be the same whether a 3 pound load or a 15 pound load is being dried, for example.

Accordingly, given the above problems with conventional dryers there is a need for control of a dryer that better determines and indicates the dryness state of a clothes load and more accurately predicts an appropriate drying time. In addition, there is a need for estimating remaining drying time taking into account different load sizes and types.

SUMMARY OF THE PRESENT INVENTION

The above needs and other needs are met by the present invention that provides a method and apparatus for controlling a dryer employing a fuzzy logic scheme that utilizes multiple sensor inputs to better determine the drying state of a clothes load and predict an appropriate drying time. In addition, a method and apparatus are provided to detect when a clothes load is in an acceptable range of dampness and alert a user of the dampness state. The method and apparatus may utilize a user's cycle selections to provide further information on a clothes load, thus further assisting to determine an appropriate drying time for the load.

According to one aspect of the invention, a methodology is provided for controlling dryer by first selecting a first prescribed drying cycle setting prior to a start of a drying cycle. Next, moisture information within the dryer is monitored over a predetermined period of time. At least a portion of a time of the drying cycle is then set using predetermined fuzzy logic functions and rules based on the selected first prescribed drying cycle setting and at least the monitored moisture information. By utilizing fuzzy logic, the dryer cycle can be more accurately controlled by accommodating for degrees of variables present in differing clothes loads.

According to another aspect of the present invention, an apparatus for controlling a dryer is provided for a dryer utilizing fuzzy logic for a controlling a dryer includes a user interface for receiving a drying cycle selection from a user. At least one moisture sensor is provided for sensing moisture level of a clothes load in the dryer. A controller receives inputs from the user interface and the at least one moisture sensor and includes a fuzzy logic control portion. The controller is configured to determine one or more time dependent parameters based on information input from the at least one moisture sensor and input the one or more parameters to the fuzzy logic control portion. The fuzzy logic control portion within the controller is configured to calculate fuzzy logic rules that determine drying cycle modification information based on predetermined fuzzy logic functions within the fuzzy logic portion. Also, the fuzzy logic control portion determines clothes load characteristics based on the one or more parameters. The fuzzy logic control portion is further configured to output the drying cycle modification information to the controller, which modifies the drying cycle in accordance with the drying cycle modification information.

Additional advantages and novel features of the invention will be set forth, in part, in the description that follows and, in part, will become apparent to those skilled in the art upon examination of the following or may be learned by practice of the invention. The advantages of the invention may be realized and attained by means of the instrumentalities and combinations particularly pointed out in the appended claims.

BRIEF DESCRIPTION OF THE DRAWINGS

Reference is made to the attached drawings, wherein elements having the same reference numeral designation represent like elements throughout and wherein:

FIGS. 5A and 5B illustrate fuzzy logic rules according to an embodiment of the present invention; and FIGS. 6A and 6B illustrate fuzzy logic rules according to another embodiment of the present invention utilizing exhaust temperature detection.

DETAILED DESCRIPTION OF THE PREFERRED EMBODIMENTS

Figure 1:
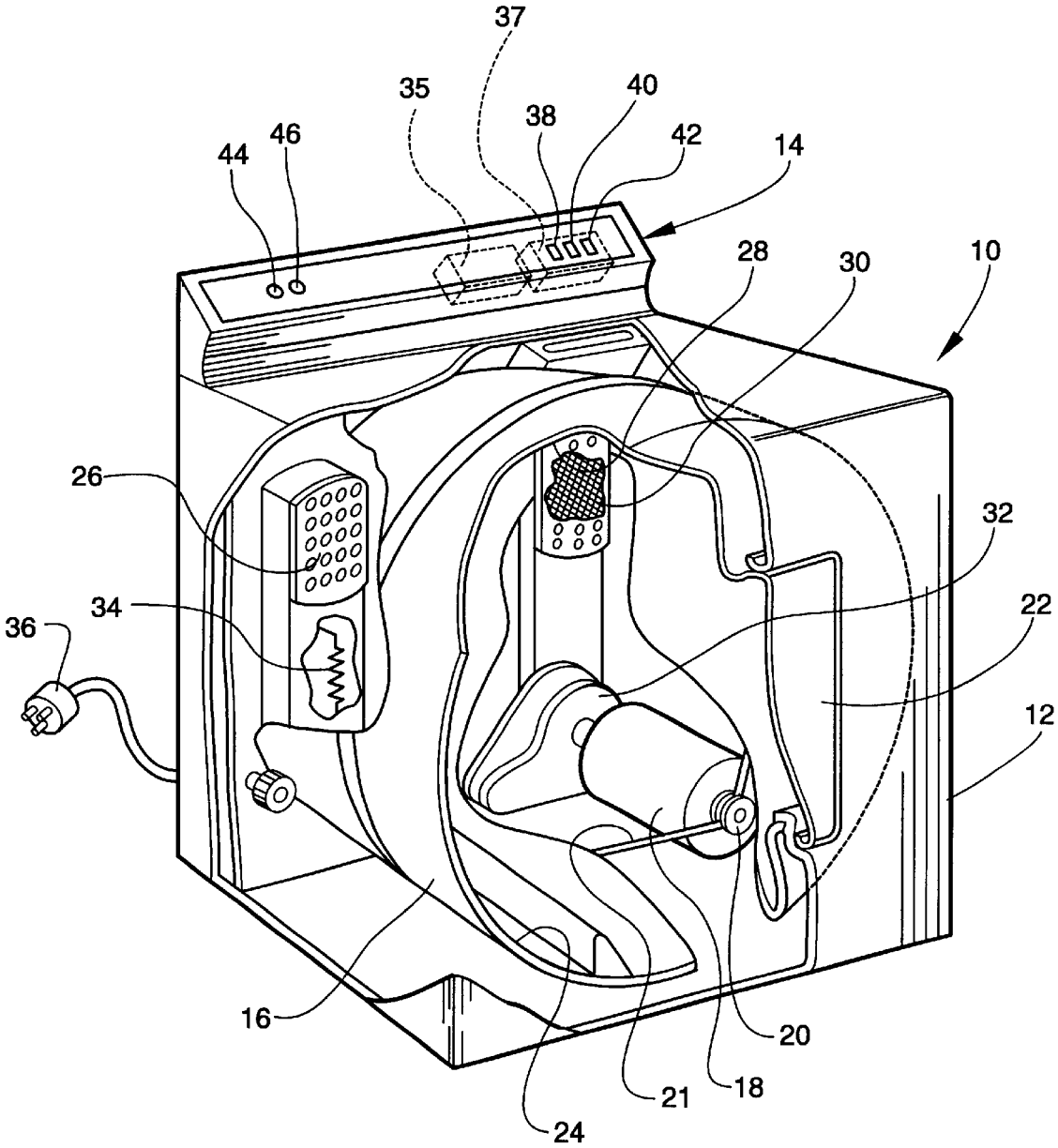
FIG. 1 is a partly cut away perspective view of a clothes dryer employing the heating control of the present invention.
Figure 2:
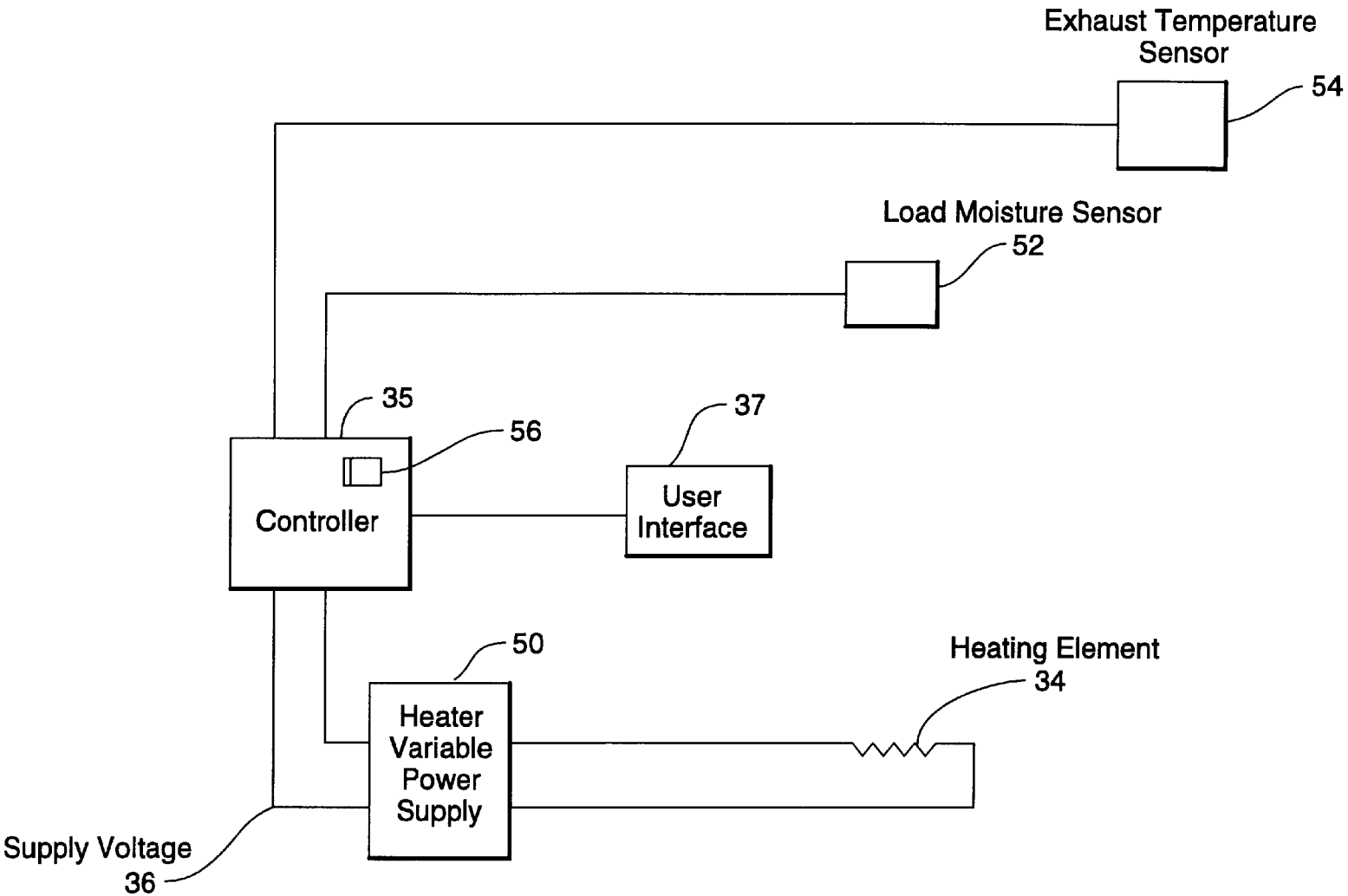
FIG. 2 is a block diagram of the control apparatus according to an embodiment of the present invention.

Referring to FIG. 1 of the drawings, an exemplary automatic clothes dryer 10 is illustrated that is controlled with the control apparatus shown in FIG. 2. Specifically in FIG. 1, the mechanical components of the clothes dryer are well known in the art and are, therefore, not shown in great detail.

The clothes dryer 10 has a cabinet 12 including a control console 14. Within the cabinet 12 is rotatably mounted a drum 16 that is rotatably driven about a horizontal axis by a motor 18 through a drive system 20, typically including a belt 21. A front door 22 formed in the front of the cabinet 12 provides selective access to the clothes treatment chamber 24 defined by the interior of the drum 16.

The drum 16 is provided with an inlet aperture 26 in an outlet exhaust aperture 28 having a removable lint screen 30. A supply of air is circulated by a fan 32 driven by the motor 18. A heating element 34 is selectively energized by a heater variable power supply 50, shown in FIG. 2, that is controlled by a controller 35 within the control console 14, for example. As is well known in the art, supply of temperature control air is circulated by the fan 32 past the heating element 34 through the inlet aperture 26 into the clothes treatment chamber 24 within the drum 16 and subsequently output through the outlet exhaust aperture 28 including the lint screen 30.

The control console 14 includes a user interface 37 having, for example, a start button 38 and a cycle selector 40 to permit the user to start a drying cycle, as well as select the parameters of the drying cycle. In the preferred embodiment, the cycle selector 40 permits selections such as "Cotton/Towels", "Jeans", "Bulky Items", "Normal Load", "Delicate/Casual" and "Ultra-Delicate". Alternately, those skilled in the art will recognize that one or more of the cycle selections such as "Jeans" or "Bulky Items" may be made with a push button or knob control as indicated at 44 and 46. Further, the user interface 37 may also include means to allow a user to set time settings (not shown) such as the period of time in which the dryer is allowed to operate.

FIG. 1 also illustrates that a controller 35 for controlling the drying cycle operation maybe located within the control console 14. The controller 35 receives inputs from an exhaust temperature sensor 54 and a load moisture sensor 52 as shown in FIG. 2. The exhaust temperature sensor 54 may be comprised of a thermistor or any other temperature sensing device known in the art. The load moisture sensor 52 may be comprised of resistance strips or any other moisture measuring devices known in the art. When moisture is present on the load moisture 52, the resistance of the resistance strip, for example, decreases and the decreased resistance is monitored as an indication of moisture presence. Additionally, the controller 35 receives inputs from the user interface 37 to set and change variables used in the control operation. The controller 35 also outputs a signal to a heater variable power supply 50 that varies the output of the power supply 50 delivered to the heating element 34. Typically, the heater power supply 50 is supplied with power from a 208 V.A.C. or 240 V.A.C. power source by means of a three wire pigtail 36.

The controller 35 also includes a fuzzy logic control portion 56 that receives two inputs based on information from the load moisture sensor 52 and the exhaust temperature sensor 54. The inputs to the fuzzy logic control portion 56 are designated as TIME0 and NUM25_27. The fuzzy logic control portion 56 also outputs information to control the variable power supply 50, which controls the heating element 34. Outputs from the fuzzy logic control portion 56 include signals to add additional time required to reach a dry state or additional time required to reach a damp dry state. The outputs are labeled ADDDAMPTIME and ADDDRYTIME.

The output signals from the fuzzy logic control portion 56 are capable of modification based on a user cycle selection from the user interface 37. Additionally, temperature information from the exhaust temperature sensor 54 is also further used to modify the outputs of the fuzzy logic control portion 56, as will be described later.

Figure 3:
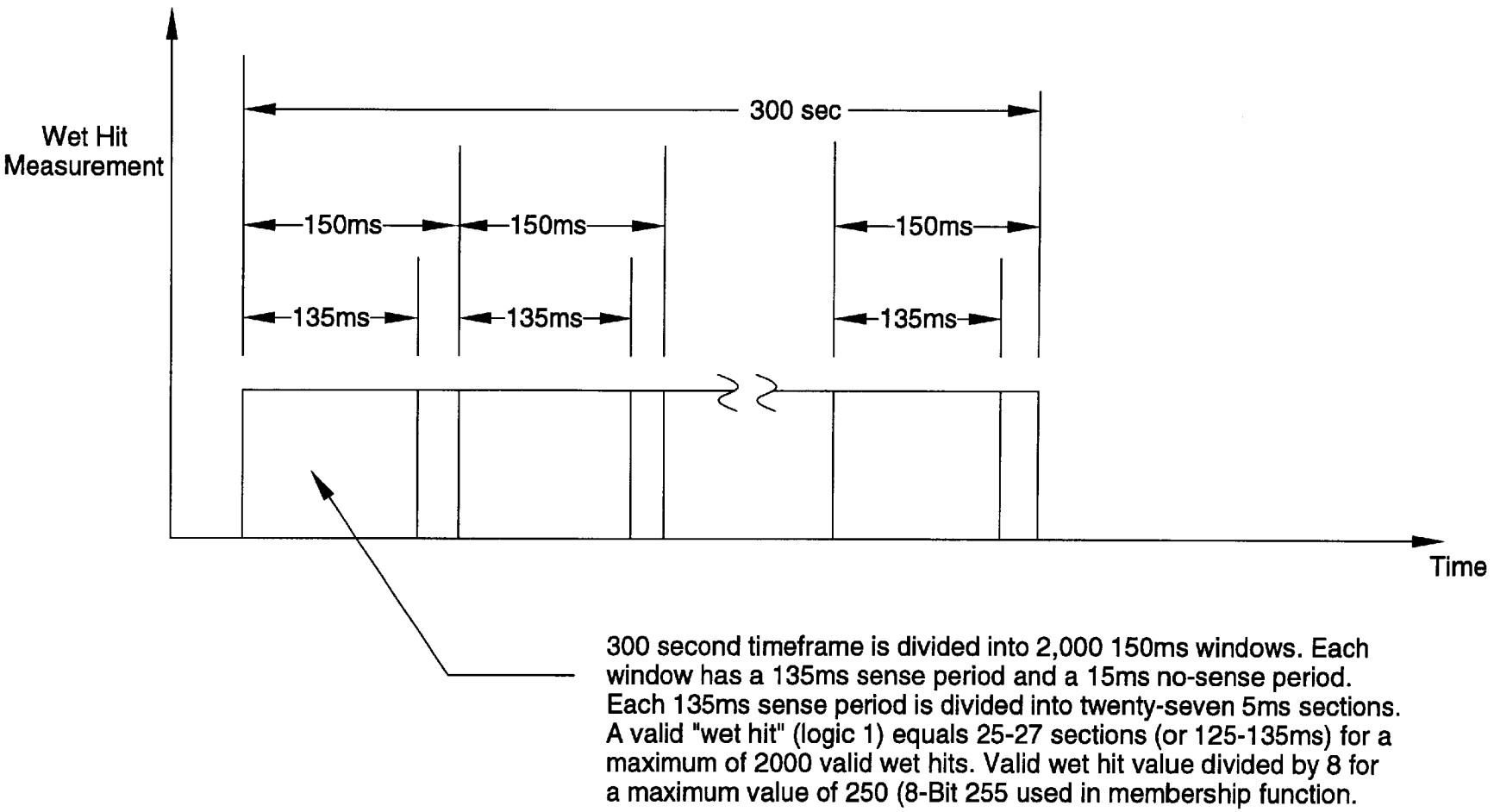
FIG. 3 illustrates the sampling periods for measuring wet hits according to an embodiment of the present invention.

In operation, the controller 35 samples the load moisture sensor 52 during the first 5 minutes of an automatic drying cycle according to a preferred embodiment. During this five minute interval, the controller 35 samples the load moisture sensor 52 using 2000 sequential 150 millisecond time windows as shown in FIG. 3. Each 150 millisecond time window is further divided into a 135 millisecond sensing period and a 15 millisecond no-sense period. During the 135 millisecond sense period, the controller 35 samples input from the moisture sensor 52 every 5 milliseconds for a maximum count of 27 indications of moisture in the clothes load (also referred to as "wet hits"). The controller 35 assigns a digital value of 1 to a "wet hit" measurement and a value of 0 when a wet hit is not registered during a sample time. Since the load moisture sensor 52 is preferably comprised of a conductivity strip, a wet hit is produced when moisture causes a change in the conductivity of the load moisture sensor 52. Over the 135 millisecond window time period, the number of wet hits corresponding to a digital value of 1 are summed. In turn, a sum of 24 or fewer wet hits over the 135 millisecond sense period (corresponding to total wet hit time of 0–124 milliseconds) is defined by the controller 35 as an invalid wet hit or logic value "0". If 25 to 27 wet hits are sampled during the 135 millisecond sampling period (corresponding to 125–135 milliseconds of total wet time), the controller 35 assigns a value of "1" for this sampling, which is considered a valid wet hit.

The controller 35 then further summarizes the number of valid wet hits over the five minute period. The input TIME0 is determined as the total time from the beginning of a dryer cycle to a point in time when the load moisture sensor 52 has not registered 25 to 27 wet hits (i.e., valid wet hits) over each 150 millisecond sampling period for 120 consecutive seconds according to a preferred embodiment. It will be appreciated by those skilled in the art, however, that other time periods may be prescribed dependent on particular drying loads or criteria. According to a preferred embodiment, the value NUM25_27 is determined by the sum of total of valid wet hits (i.e., 25 to 27 moisture indication per 150 millisecond period) occurring during the five minute period divided by the number 8.

It will be appreciated by those of skill in the art that the clothes load size, type and moisture content influence the inputs TIME0 and NUM25_27. For example, the NUM25_27 increases with larger and more flexible clothes loads. For example, given the same moisture retention, a 9 pound jeans load will have a smaller NUM25_27 value than a 9 pound mixed clothes load since jeans are stiffer and thicker and, thus, the jeans will make fewer contacts with the load moisture sensor 52 than the more flexible loads. Additionally, the TIME0 value is larger for a jeans load than for a mixed load since the jeans load takes considerably longer to dry than a mixed load.

As the fuzzy logic control portion 56 receives these two inputs, the drying cycle parameters can be adjusted according to predetermined sets of membership functions representing different fabric types, blends and weights. As the dryer operates, conclusions are made within the fuzzy logic control portion 56 as degrees of fulfillment of each term in the membership functions are obtained. Based on the degree of fulfillment, the fuzzy logic control portion 56 then utilizes predetermined rule bases to assign additional damp time or drying time (i.e., ADDDAMPTIME and ADDDRYTIME).

Figure 4A:
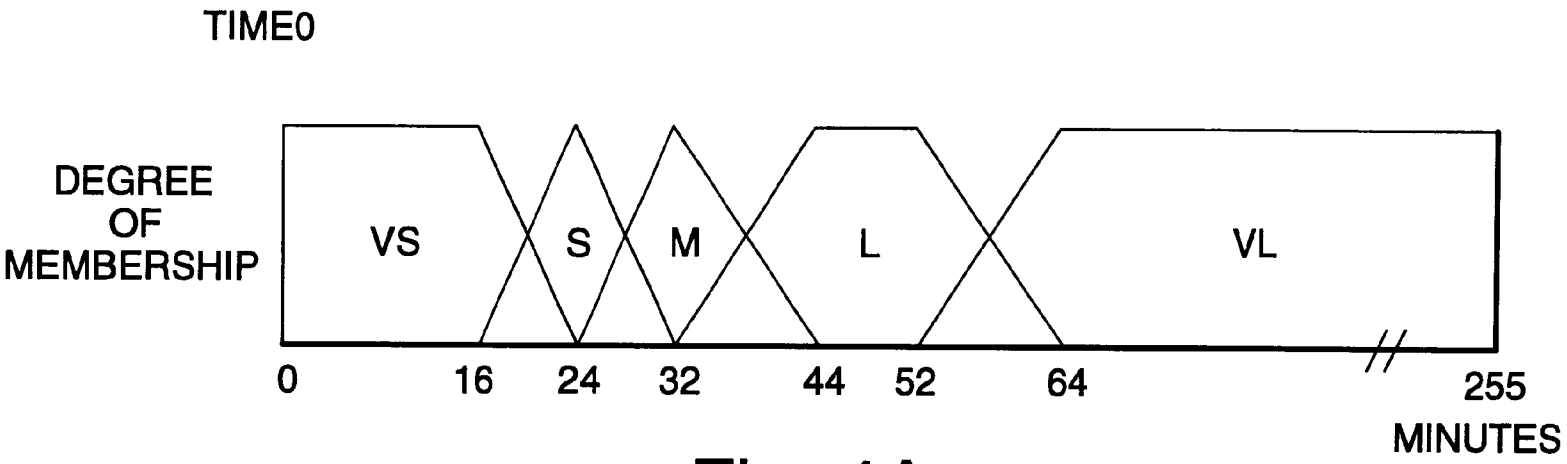
FIGS. 4A, 4B, 4C and 4D illustrates fuzzy logic functions according to an embodiment of the present invention.

According to a preferred embodiment of the present invention, the membership functions include designation of very small through very large drying terms. A term's degree of fulfillment is determined by load size, load type and moisture content, for example. The membership functions according to the present embodiment are abbreviated as VS for very small, S for small, M for medium, L for large and VL for very large. As shown in FIG. 4A, the particular values of the input TIME0 determine which term the fuzzy logic control portion 56 uses to decide membership of the particular drying term within the term size categories. For example, for values of TIME0 from 0 to 16 minutes, the fuzzy logic controller will accord full degree of membership of the particular load in the very small VS category. As the time increases above 16 minutes, however, the degree of membership of the particular term in the very small category falls within a degree of membership less than full membership. Furthermore, the possibility that the membership term could be categorized as small S arises after a TIME0 value of 16 minutes. At some point between TIME0 values of 16 to 24 minutes, the degree of membership of the term is more likely to be small S instead of very small VS. Similarly, the membership within the other load size categories is determined as the TIME0 values increase. It will be appreciated by those having skill in the art that other membership functions could be set based on the particular applications and types of loads.

Figure 4B:
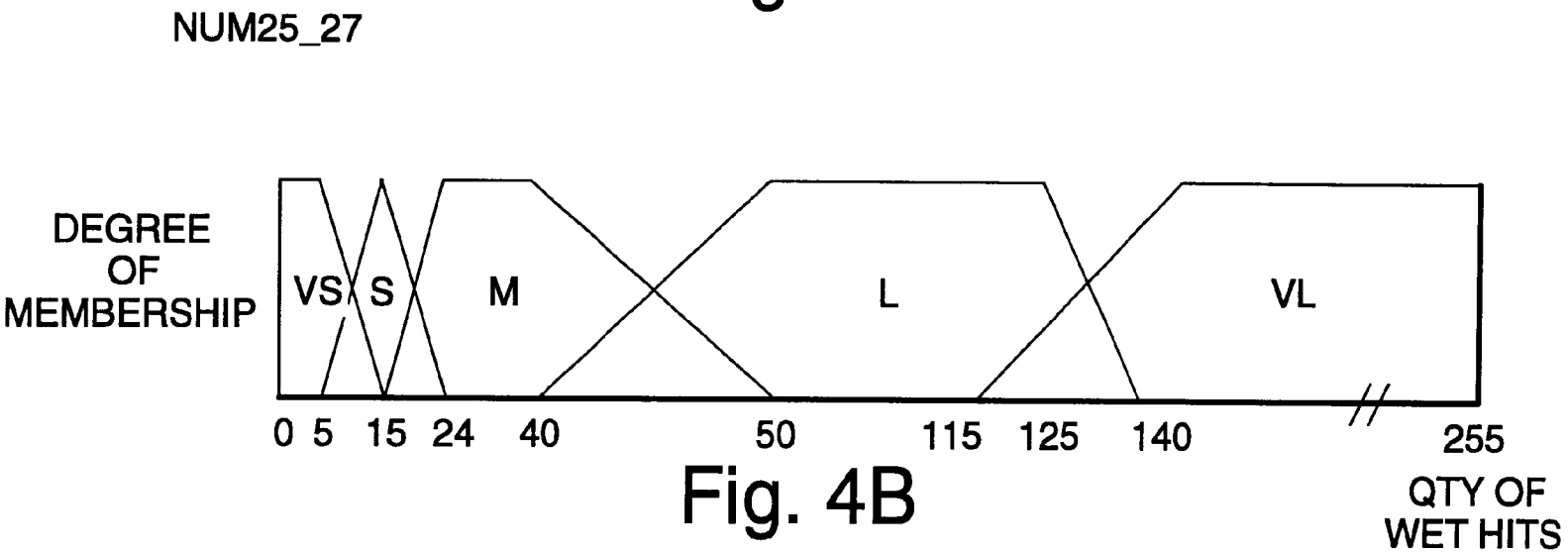

FIG. 4B similarly shows the membership functions for values of NUM25_27 used by the fuzzy logic control portion 56 to determine the classification of a load within the load size categories for various values of NUM25_27.

Based on an input cycle selection from the user interface 37, a particular rule basis is determined by the fuzzy logic control portion 56 for each particular cycle selection. Examples of cycle selections are Cotton/towels (heavy), normal, delicate/casual and ultradelicate. Further cycle selections can include jeans and bulky items. Examples of rule bases calculated for Cotton/towels and normal cycle selections are illustrated in table form in FIGS. 5A and 5B, respectively. These tables illustrate values for ADDDRYTIME and ADDDAMPTIME based on the load type determined from the membership functions of TIME0 and NUM25_27. The format for the outputs of ADDDRYTIME and ADDDAMPTIME, which are output from the fuzzy logic control portion 56, is X/Y, where X is ADDDRYTIME and Y is ADDDAMPTIME. Thus, for example, if the value of TIME0 determines a load type of small S and the NUM25_27 value yields a load type of medium, the rule base shown in FIGS. 5A dictates that 3 minutes of additional time is added to the drying cycle for reaching the damp dry state and 18 additional minutes are added to the drying cycle to reach the dry state.

Figure 4C:
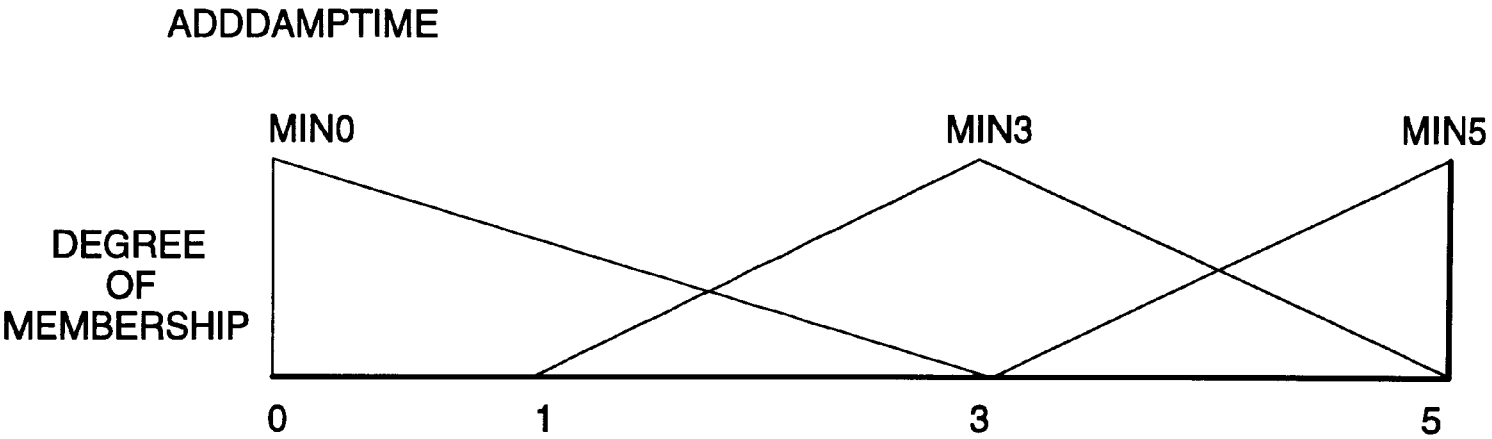
Figure 4D:
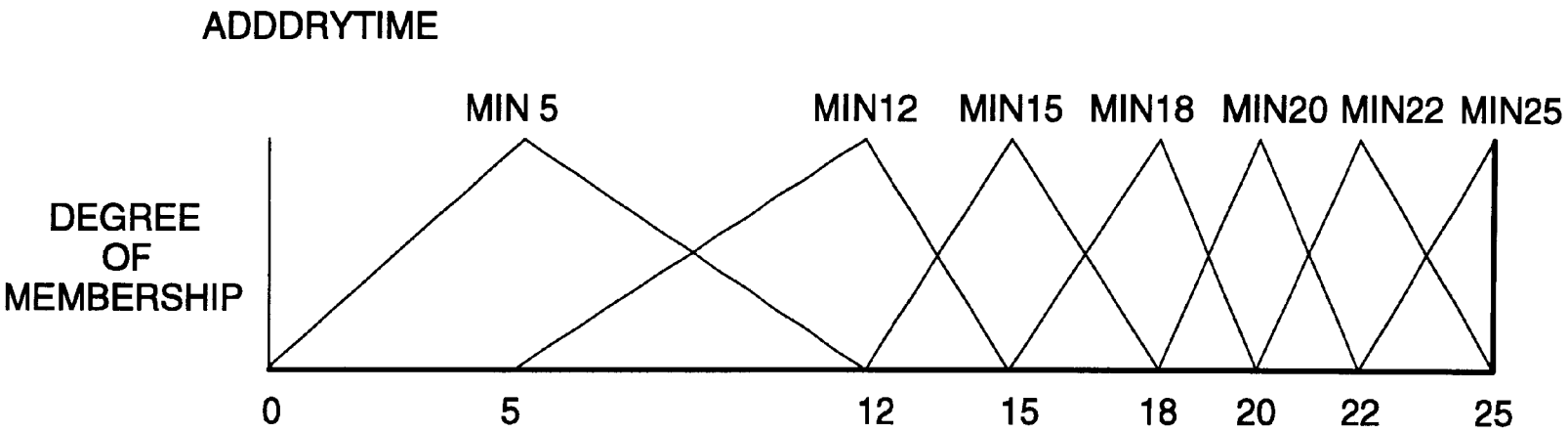

FIGS. 4C and 4D further respectively illustrate exemplary membership functions for ADDDAMPTIME and ADDDRYTIME that were used to determine the rule bases such as those shown in FIGS. 5A and 5B.

In addition, the rule basis can be modified for more particular types of clothes being dried. For example, jeans and bulky items may take longer to dry than other types of items using the heavy cycle selection rule table shown in FIG. 5A. Accordingly, the rule base can be modified for jeans and bulky item cycles by further adding additional time to the ADDDRYTIME prescribed by the rule base. For example, for a jeans cycle, 15 additional minutes could be added to the ADDDRYTIME to ensure dryness of the load.

According to another preferred embodiment of the present invention, the temperature can be reduced throughout the drying cycle while utilizing the TIME0, NUM25_27, ADDDAMPTIME and ADDDRYTIME membership functions and prescribed rule bases. By utilizing temperature input from the exhaust temperature sensor 54, the fuzzy logic control portion 56 can control the energy delivered to the heating element 34 via the power supply 50.

During a typical drying cycle, the temperature of the heating element 34 is reduced after an indication of damp drying of the load. Typically, the indication of damp drying occurs at about 20 percent humidity level. Humidity levels below this amount typically fail to register wet hits on the load moisture sensor 52. By better determining when heat can be reduced during the drying cycle can improve fabric care by reducing the overall fabric temperature. An exemplary rule base that can be utilized is shown in FIGS. 6A and 6B. As shown in FIG. 6A, dependent on the drying cycle selected via the user interface 37, different rules apply for applying heating power levels to the heating element 34. FIG. 6B provides definitions of the temperature ranges utilized by the rule shown in FIG. 6A. For example, when the cotton/towels cycle is selected, high heat, which corresponds to a sensed temperature range between 143° F. and 155° F., is applied until a damp signal corresponding to approximately 20 percent humidity is registered in the controller 35. The damp signal, which corresponds to a damp dry condition, can be determined when no wet hits occur on the load moisture sensor 52 for a prescribed period of time. Once a damp signal has issued, the temperature is reduced to medium high heat, which corresponds to a range between 138° F. and 150° F., until the cool down portion of the drying cycle. The cool down portion of the cycle is that portion which power to the heating element 34 is terminated but the drum 16 is still rotated for a predetermined period of time, such as 5 minutes.

In the present embodiment, the damp dry signal timing is determined by the ADDDAMPTIME. Specifically, the point at which the load moisture sensor 52 fails to provide any further wet hits, the additional damp drying time (i.e., ADDDAMPTIME) is initiated. At the end of the additional damp drying period, as has been determined by the fuzzy logic control portion 56, a damp dry signal is issued by the controller 35. The particular paradigm programmed into the fuzzy logic control portion 56 calculates an additional damp dry time (i.e., ADDDAMPTIME) to approximate 20 percent humidity of the clothes load at the end of the additional damp dry time. Of course, different paradigms can be programmed into the fuzzy logic control portion 56 to achieve either higher or lower damp dry humidity percentages.

Furthermore, the application of further heating after the damp dry signal issuance shown in FIG. 6A for cycles such as cotton/towels, jeans, bulky items, normal, delicate/casual and ultra-delicate is applied for the additional drying time determined by the fuzzy logic control portion 56 (i.e., ADDDRYTIME). Thus, the additional drying time ADDDRYTIME is the time from the damp dry condition until the cool down period of the drying cycle. Of particular note, the normal drying cycle shown in FIG. 6A automatically applies high heat for the first 5 minutes of the drying cycle, during which time period the data collection for determining the values TIME0 and NUM25_27 are determined. After this time period, the heat is reduced to medium high level until such time when no further moisture information can be registered by the load moisture sensor 52.

In the above-described embodiments, the fuzzy logic rule bases were illustrated in tabular form. This table may comprise a predetermined lookup table within the fuzzy logic portion 56 for simply looking up the ADDDRYTIME and ADDDAMPTIME values based on the values TRME0 and NUM25_27 that are determined during the initial period of the drying cycle. However, the fuzzy logic control portion 56 may also feature using the fuzzy logic engine contained in this portion to calculate the rule basis with each dryer operation. Hence, given empirically determined parameters that are programmed into either a software or hardware implementation of the fuzzy logic engine, the additional dry and damp times are calculated. In addition, for each cycle selection, multiple rule bases can be utilized to calculate the additional dry and damp times. For example, in the heavy cycle selection rule basis illustrated in FIG. 5, each of the 25 possible dry and damp time determinations could each be calculated using a corresponding rule. Furthermore, each of these rules can be programmed to have various exceptions based on other inputs such as temperature input.

According to yet another preferred embodiment, the fuzzy logic control portion 56 can be programmed to calculate only additional drying time without the additional damp time or, conversely, calculate only additional damp time without calculating additional drying time. In the alternative, for example, the fuzzy logic control portion 56 calculates a ADDDRYTIME value for each of the possible combinations of load sizes determined for each of the TIME0 and NUM25_27 values further based on the type of cycle selected (e.g., heavy, normal, permanent press and delicate).

The above provides a detailed description of the best mode contemplated for carrying out the present invention at the time of filing the present application by the inventors thereof It will be appreciated by those skilled in the art that many modifications and variations, which are included within the intended scope of the claims, may be made without departing from the spirit of the invention.

What is claimed is:

1. A method for controlling a dryer comprising the steps of:

selecting a first prescribed drying cycle setting prior to a start of a drying cycle;

monitoring moisture information within the dryer over a predetermined period of time; and setting a first additional time period for the clothes load to reach a predetermined damp condition and a second additional time period for the clothes load to reach a predetermined dry condition for the drying cycle using predetermined fuzzy logic functions and rules based on the selected first prescribed drying cycle setting and at least the monitored moisture information.

2. A method for controlling a dryer comprising the steps of:

selecting a first prescribed drying cycle setting prior to a start of a drying cycle;

monitoring the moisture content of the clothes load to determine a first parameter based on the time from the start of the cycle to when moisture indications reach a predetermined level;

monitoring the moisture content of the clothes load over a predetermined period of time to determine a second parameter based on the number of determinations that moisture indications exceeded a predetermined threshold; and setting at least a portion of a time of the drying cycle using predetermined fuzzy logic functions and rules based on the selected first prescribed drying cycle setting and the first and second monitored moisture parameters.

3. The method according to claim 2, wherein the first prescribed drying cycle is selected from the group which includes at least one of cotton/towels load cycle, jeans load cycle, normal load cycle, delicate/casual load cycle, bulky load cycle and ultra-delicate clothing load cycle.

4. A method for controlling a dryer comprising the steps of:

selecting a first prescribed drying cycle setting prior to a start of a drying cycle;

monitoring moisture information within the dryer over a predetermined period of time; and setting at least a portion of a time of the drying cycle using predetermined fuzzy logic functions and rules based on the selected first prescribed drying cycle setting and at least the monitored moisture information, wherein the step of monitoring the moisture information further comprises the steps of:

counting a first number of moisture indications occurring in a moisture sensor within a prescribed time interval and determining whether the first number of moisture indications exceeds a predetermined threshold during the prescribed time interval; and summing a number of determinations that the first number of moisture indications has exceeded the predetermined threshold during the predetermined period of time.

5. The method according to claim 4, wherein the prescribed time interval is 135 milliseconds.

6. The method according to claim 5, wherein the predetermined threshold is 25 moisture indications.

7. The method according to claim 4, wherein the predetermined period of time is 5 minutes.

8. The method according to claim 4, further comprising:

determining at least one characteristic of a clothes load using a fuzzy logic function based on the sum of the number of determinations that the first number of moisture indications has exceeded the predetermined threshold during the predetermined period of time; and calculating a fuzzy logic rule using the predetermined fuzzy logic that establishes control of at least one characteristic of the drying cycle based on one or more of the determined at least one characteristic of the clothes load and the first prescribed drying cycle setting.

9. The method according to claim 8, wherein the at least one characteristic of the clothes load includes a size of the clothes load.

10. The method according to claim 8, wherein the at least one characteristic of the drying cycle includes at least one of additional drying time and additional damp time.

11. The method according to claim 4, wherein the step of monitoring the moisture information further comprises the steps of:

starting a time count from the start of the drying cycle;

determining moisture indications occurring in a moisture sensor in relation to a predetermined moisture level; and stopping the time count when moisture indications occurring in the moisture sensor do not exceed the predetermined moisture level for a prescribed time period and storing the time count when stopped.

12. The method according to claim 11, wherein the prescribed time period is 120 seconds.

13. The method according to claim 11, wherein the predetermined moisture level threshold is 25 moisture indications occurring during a 135 millisecond time period.

14. The method according to claim 11, further comprising the steps of:

determining at least one characteristic of a clothes load using a fuzzy logic function based on the stored time; and calculating a fuzzy logic rule using the predetermined fuzzy logic that establishes control of at least one characteristic of the drying cycle based on one or more of the determined at least one characteristic of the clothes load and the first prescribed drying cycle setting.

15. The method according to claim 14, wherein the at least one characteristic of the clothes load includes a size of the clothes load.

16. The method according to claim 14, wherein the at least one characteristic of the drying cycle includes at least one of additional drying time and additional damp time.

17. The method according to claim 2, further comprising the steps of:

monitoring exhaust temperature of the dryer;

varying at least one of the drying cycle time and dryer input temperature based on the monitored exhaust temperature using the predetermined fuzzy logic.

18. A control apparatus utilizing fuzzy logic for a controlling a dryer comprising:

a user interface for receiving a drying cycle selection from a user;

at least one moisture sensor for sensing moisture level of a clothes load in the dryer; and a controller including a fuzzy logic portion;

said controller receiving inputs from the user interface and the at least one moisture sensor and configured to determine a first time dependent parameter based on the time from the start of the cycle to when moisture indications from the at least one moisture sensor reach a predetermined level, and a second parameter based on the number of determinations that moisture indications exceeded a predetermined threshold in a predetermined period, and to input the first and second parameters to the fuzzy logic control portion, and the fuzzy logic control portion configured to apply fuzzy logic rules that determine drying cycle modification information based on predetermined fuzzy logic functions within the fuzzy logic portion, which determines clothes load characteristics based on the first and second parameters, and to output the drying cycle modification information to controller, which modifies the drying cycle in accordance with the drying cycle modification information.

19. The apparatus according to claim 18, wherein the drying cycle selection includes drying cycles selected from the group which includes at least one of cotton/towels load cycle, jeans load cycle, normal load cycle, delicate/casual load cycle, bulky load cycle and ultra-delicate clothing load cycle.

20. A control apparatus utilizing fuzzy logic for a controlling a dryer comprising:

a user interface for receiving a drying cycle selection from a user;

at least one moisture sensor for sensing moisture level of a clothes load in the dryer; and a controller receiving inputs from the user interface and the at least one moisture sensor, the controller including a fuzzy logic control portion and configured to determine one or more time dependent parameters based on information input from the at least one moisture sensor and input the one or more parameters to the fuzzy logic control portion, and the fuzzy logic control portion configured to apply fuzzy logic rules that determine drying cycle modification information based on predetermined fuzzy logic functions within the fuzzy logic portion, which determines clothes load characteristics based on the one or more parameters, and to output the drying cycle modification information to controller, which modifies the drying cycle in accordance with the drying cycle modification information, wherein the controller is configured to determine at least one of the time dependent parameters by counting a first number of moisture indications occurring in a moisture sensor within a prescribed time interval and determining whether the first number of moisture indications exceeds a predetermined threshold during the prescribed time interval, and sum a number of determinations that the first number of moisture indications has exceeded the predetermined threshold during the predetermined period of time.

21. The apparatus according to claim 20, wherein the prescribed time interval is 135 milliseconds.

22. The apparatus according to claim 21, wherein the predetermined threshold is 25 moisture indications.

23. The apparatus according to claim 20, wherein the predetermined period of time is 5 minutes.

24. The apparatus according to claim 20, wherein the fuzzy logic control portion is configured to determine the at least one characteristic of the clothes load using a predetermined fuzzy logic function based on the sum of the number of determinations that the first number of moisture indications has exceeded the predetermined threshold during the predetermined period of time.

25. The apparatus according to claim 18, wherein the at least one clothes load characteristic includes a size of the clothes load.

26. The apparatus according to claim 18, wherein the drying cycle modification information includes at least one of additional drying time and additional damp time.

27. The apparatus according to claim 18, wherein the controller is configured to start a time count from a start of the drying cycle, determine moisture indications occurring in the at least one moisture sensor in relation to a predetermined moisture level, and stop the time count when moisture indications occurring in the moisture sensor do not exceed the predetermined moisture level for a prescribed time period and storing the time count when stopped.

28. The apparatus according to claim 27, wherein the prescribed time period is 120 seconds.

29. The apparatus according to claim 27, wherein the predetermined moisture level threshold is 25 moisture indications occurring during a 135 millisecond time period.

30. The apparatus according to claim 27, wherein the fuzzy logic control portion is configured to determine at least one of the clothes load characteristics using a fuzzy logic function based on the stored time, and calculate a fuzzy logic rule using the predetermined fuzzy logic that establishes control of at least one characteristic of the drying cycle based on one or more of the determined at least one clothes load characteristic and the drying cycle selection.

31. The apparatus according to claim 30, wherein the at least one clothes load characteristic includes a size of the clothes load.

32. The apparatus according to claim 30, wherein the drying cycle modification information includes at least one of additional drying time and additional damp time.

33. The apparatus according to claim 18, further comprising:

a dryer exhaust temperature monitor inputting a signal to the controller; and wherein the controller is configured to vary at least one of the drying cycle time and dryer input temperature based on the monitored exhaust temperature using the fuzzy logic control portion.

34. A method for controlling a dryer comprising the steps of:

selecting a first prescribed drying cycle setting prior to a start of a drying cycle;

monitoring the moisture content of the clothes load to determine a first parameter based on the time from the start of the cycle to when moisture indications reach a predetermined level;

monitoring the moisture content of the clothes load over a predetermined period of time to determine a second parameter based on the number of determinations that moisture indications exceeded a predetermined threshold; and setting a first additional time period for the clothes load to reach a predetermined damp condition and a second additional time period for the clothes load to reach a predetermined dry condition for the drying cycle using predetermined fuzzy logic functions and rules based on the selected first prescribed drying cycle setting and the first and second parameters.

35. A control apparatus utilizing fuzzy logic for automatically controlling the duration of a clothes dryer cycle comprising:

a user interface for receiving a drying cycle selection from a user;

at least one moisture sensor for sensing moisture level of the clothes load in the dryer; and a controller including a fuzzy logic control portion;

said controller receiving inputs from the user interface and the at least one moisture sensor and configured to determine one or more time dependent parameters based on information input from the at least one moisture sensor and the user interface input, and to input the one or more parameters to the fuzzy logic control portion; and said fuzzy logic control portion configured to determine clothes load characteristics based on the user interface input and the one or more parameters and to apply fuzzy logic rules that determine a first additional drying time for the clothes load to reach a predetermined damp condition and a second additional drying time to reach a predetermined dry condition based on predetermined fuzzy logic functions within the fuzzy logic portion, and output the additional drying time information to the controller to incorporate the first and second additional drying times into the drying cycle.

36. A control apparatus utilizing fuzzy logic for a controlling a dryer comprising:

a user interface for receiving a drying cycle selection from a user;

at least one moisture sensor for sensing moisture level of a clothes load in the dryer; and a controller including a fuzzy logic portion;

said controller receiving inputs from the user interface and the at least one moisture sensor and configured to determine a first time dependent parameter based on the time from the start of the cycle to when moisture indications from the at least one moisture sensor reach a predetermined level, and a second parameter based on the number of determinations that moisture indications exceeded a predetermined threshold in a predetermined period, and to input the user interface input and the first and second parameters to the fuzzy logic control portion; and said fuzzy logic control portion configured to determine clothes load characteristics based on the user interface input and said first and second parameters and to apply fuzzy logic rules that determine a first additional drying time for the clothes load to reach a predetermined damp condition and a second additional drying time to reach a predetermined dry condition, and to output the additional drying time information to controller to incorporate the first and second additional drying times into the drying cycle.

* * * * *